United States Patent [19]

Kessler

[11] Patent Number: 4,967,908

[45] Date of Patent: Nov. 6, 1990

[54] APPARATUS FOR TRANSPORTING ARTICLES

[75] Inventor: William I. Kessler, Sheboygan, Wis.

[73] Assignee: The Vollrath Company, Inc., Sheboygan, Wis.

[21] Appl. No.: 438,738

[22] Filed: Nov. 17, 1989

[51] Int. Cl.[5] ..... B65D 21/00

[52] U.S. Cl. ..... 206/518; 206/506; 206/515; 206/519; 206/503

[58] Field of Search ..... 206/503, 512, 513, 515, 206/518, 519, 520, 557, 203, 821, 505, 506; 220/74

[56] References Cited

U.S. PATENT DOCUMENTS

| | | | |
|---|---|---|---|
| 2,300,317 | 10/1942 | Scherer | 206/518 |
| 3,169,659 | 2/1965 | Blackmore | 206/506 |
| 3,208,631 | 9/1965 | Edwards | 229/1.5 B |
| 3,670,922 | 6/1972 | Phillips | 206/519 |
| 4,113,095 | 9/1978 | Dietz et al. | 206/518 |
| 4,373,642 | 2/1983 | Walters et al. | 206/519 |
| 4,616,762 | 10/1986 | Alexander | 220/74 |
| 4,648,522 | 3/1987 | Wise | 206/519 |
| 4,660,734 | 4/1987 | Heaney et al. | 206/518 |
| 4,804,092 | 2/1989 | Jones | 206/518 |
| 4,828,112 | 5/1989 | Vollrath et al. | 206/519 |

FOREIGN PATENT DOCUMENTS

| | | | |
|---|---|---|---|
| 1786623 | 9/1982 | Fed. Rep. of Germany | 206/515 |
| 2295883 | 7/1976 | France | 206/519 |

*Primary Examiner*—David T. Fidei
*Attorney, Agent, or Firm*—Foley & Lardner

[57] ABSTRACT

An apparatus for transporting articles comprising a transporting well having a generally planar polygonal bottom and a plurality of walls, each of which walls being joined substantially at its upper extremity by a substantially rigid bead structure which defines a peripheral channel adjacent the plurality of walls outboard of the well. The channel is bounded by the plurality of walls, by a web extending substantially from the upper extremities of the walls, and by a skirt depending from the web. The skirt extends a greater distance from the web in the vicinity of the corners of the well than elsewhere. The apparatus includes a channel-filling structure substantially at the center of each section of longer skirt length for precluding jamming during stacking, and stand-off ridges on the outboard side of each wall for limiting the expanse of contact area between the walls and abutting planar surfaces.

15 Claims, 3 Drawing Sheets

APPARATUS FOR TRANSPORTING ARTICLES

BACKGROUND OF THE INVENTION

The present invention is directed to an apparatus for transporting articles, and specifically addresses such apparata which are adaptable for use as a food-carrying tray.

Food service establishments employ food service trays to facilitate the carrying of food items by customers from a point of service to an area in which the food items are consumed. The food trays are collected after the customers have consumed their food; the trays are washed, and then they are returned to the point of service for reuse by other customers.

Following the washing process, the food service trays are generally stacked at the point of service so as to be readily available for subsequent use. One problem common with such use of food service trays is that, in such a stacked orientation, recently washed trays are often not able to dry thoroughly before their re-use. Further, in such environments the trays are often dropped and suffer damage such as cracking, chipping, or the like, especially at corners of the trays. Still further, stacks of food service trays often lean and become unstable because of slipping between adjacent trays in the stack. Still further, food service establishments may purchase trays from different vendors, and jamming between trays within stacks may occur between trays supplied by different vendors.

The present invention is designed to overcome the above shortcomings by providing apparata for transporting articles, such as food service trays, which are amenable to drying in a stacked orientation; are constructed to withstand rough treatment, such as dropping; stack more squarely with reduced slipping between trays in such stacked orientation, and are constructed to reduce jamming between adjacent trays within a stack.

SUMMARY OF THE INVENTION

The invention is an apparatus for transporting articles comprising a transporting well having a generally planar polygonal bottom and a plurality of walls, each of which walls depends in a first direction from the bottom to an upper extremity. Further, a substantially rigid bead structure joins each of the walls substantially at the upper extremity and defines a peripheral channel adjacent the plurality of walls outboard of the well, which channel is bounded by the plurality of walls, by a web extending substantially from the respective upper extremities of the walls, and by a skirt depending from the web. The skirt extends a first distance from the web at preselected sections of the channel, and extends a second distance from the web at other sections of the channel.

Preferably, the skirt extends a greater distance from the web in the vicinity of the corners of the well. In the preferred embodiment, each section having a longer skirt delimits an arc of substantially 90° generally centered on its respective corner. Further in the preferred embodiment, the polygonal bottom is in the shape of a rectangle.

The preferred embodiment of the present invention also includes a channel-filling structure substantially at the center of each section of longer skirt length for precluding jamming of an adjacent lower tray within the channel during stacking. The preferred embodiment also includes stand-off ridges on the outboard side of each wall for limiting the expanse of contact area between the walls and abutting substantially planar surfaces, such as would be presented by an adjacent lower tray in a stacked relationship. Preferably, the stand-off structure comprises a mass of material extending substantially perpendicularly from a respective wall, which mass of material is oriented substantially in a line extending substantially from the web, generally perpendicular to the web, and traversing at least a part of the wall.

It is, therefore, an object of the present invention to provide an apparatus for transporting articles which readily dries when in a stacked orientation.

A further object of the present invention is to provide an apparatus for transporting articles having enhanced strength and resistance to damage.

Yet a further object of the present invention is to provide an apparatus for transporting articles which will, when in a stacked orientation, exhibit limited slip between adjacent such apparata, thereby yielding enhanced stability of such stacked orientation.

Still a further object of the present invention is to provide an apparatus for transporting articles which, when in a stacked orientation, resists jamming together of adjacent such apparata.

Further objects and features of the present invention will be apparent from the following specification and claims when considered in connection with the accompanying drawings illustrating the preferred embodiment of the invention.

DETAILED DESCRIPTION OF THE DRAWINGS

DETAILED DESCRIPTION OF THE INVENTION

Figure 1:
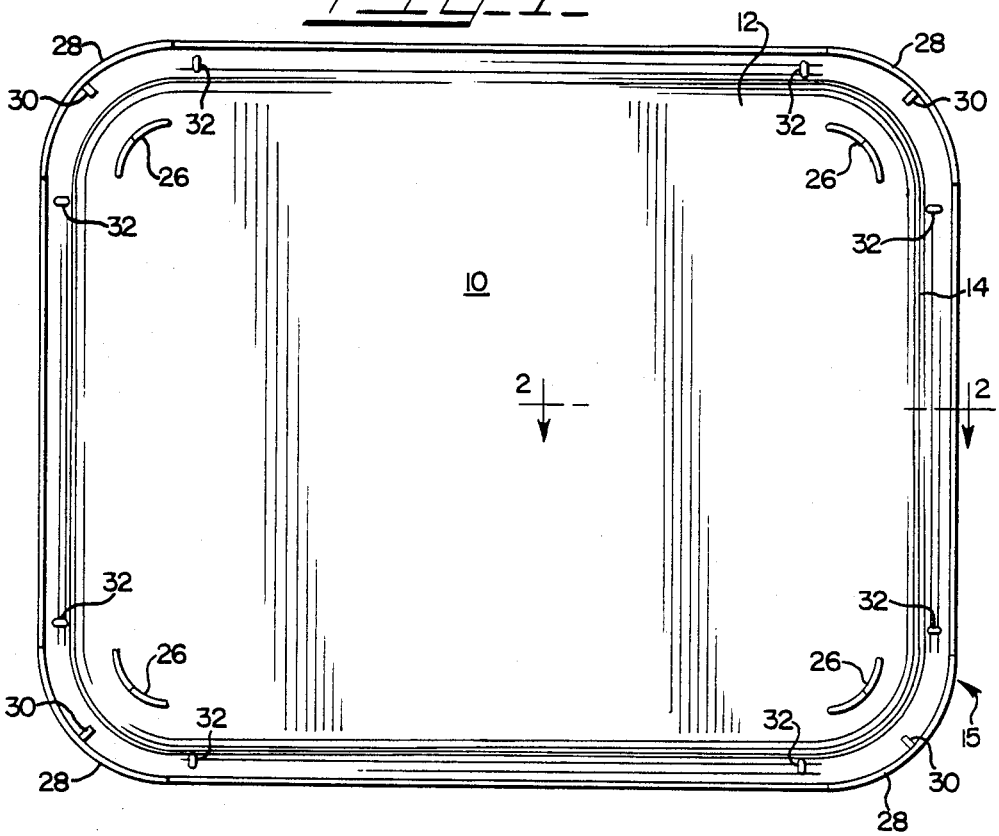
FIG. 1 is a bottom plan view of the preferred embodiment of the present invention.

The preferred embodiment of an apparatus for transporting articles 10, adaptable for use as a food-carrying tray, is illustrated in bottom plan view in FIG. 1.

Figure 2:
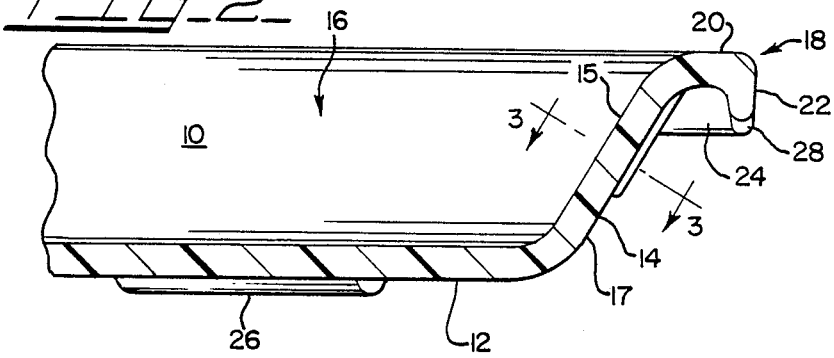
FIG. 2 is a partial section view of the preferred embodiment of the present invention taken along section 2—2 in FIG. 1.

FIG. 2 presents a partial section view of the preferred embodiment of the present invention taken along Section 2—2 in FIG. 1. It is advantageous to regard both FIGS. 1 and 2 together to fully understand the structure of the preferred embodiment of the present invention.

For ease of understanding the present invention, like elements will be referred to by like reference numerals in the various drawings.

Referring to FIGS. 1 and 2, the apparatus 10 is of generally rectangular shape, having a bottom 12 and a plurality of walls 14 depending from the bottom 12 and extending generally in a first (upward) direction from the bottom 12 to form a transportation well 16. The walls 14 cooperate with each other and with the bottom 12 to form a unitary structure defining the transportation well 16. The walls 14 terminate in a bead structure 18 which is comprised of a web 20 depending from the upper extremity of the wall 14, and a skirt 22 depending in a generally downward direction from the web 20. The bead structure 18 is likewise preferably unitary in its association with the walls 14 around the periphery of the apparatus 10. The walls 14, the web 20, and the skirt 22 define a channel 24 which circumscribes the apparatus 10 adjacent the upper extremity of the walls 14.

The apparatus 10 has a plurality of arcuate feet 26 located at respective corners of the apparatus 10. Also at respective corners of the apparatus 10 are extended skirt sections 28 in which the skirt 22 extends a further distance in the generally downward direction. The extended skirt sections 28 preferably delimit an arc of approximately 90° centered on respective corners of the apparatus 10.

In the preferred embodiment illustrated in FIGS. 1 and 2, a channel-filling structure 30, preferably in the form of a transverse rib within the channel 24 is located substantially at the center of each arc delimited by an extended skirt section 28. Further, generally adjacent the limits of each of the arcs established by extended skirt sections 28 are stand-off structures 32. The stand-off structures 32 are better understood by referring to FIG. 3.

Figure 3:
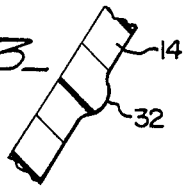
FIG. 3 is a partial section view of the preferred embodiment of the present invention taken along section 3—3 in FIG. 2.

FIG. 3 is a partial section view of the preferred embodiment of the apparatus 10 taken along Section 3—3 in FIG. 2. In FIG. 3, a stand-off structure 32 is seen to be integrally formed as a part of the wall 14. As shown in FIG. 2, the stand-off structure 32 extends in a line generally from within the channel 24, substantially at the web 20, downward along the wall 14 in a generally perpendicular direction from the web 20. Stand-off structure 32 provides a minimal surface for an adjacent planar structure to contact the wall 14, as would be the case in the situation where a plurality of the apparata 10 are nested. In such situation, the inner surface 15 of a wall 14 of a lower apparatus 10 would bear against the stand-off structures 32 integrally formed in the outer surface 17 of a wall 14 of an upper apparatus 10. By so limiting the area of contact between the two apparata, the likelihood of jamming or sticking between the two apparata in such a stacked orientation is minimized.

Figure 4:
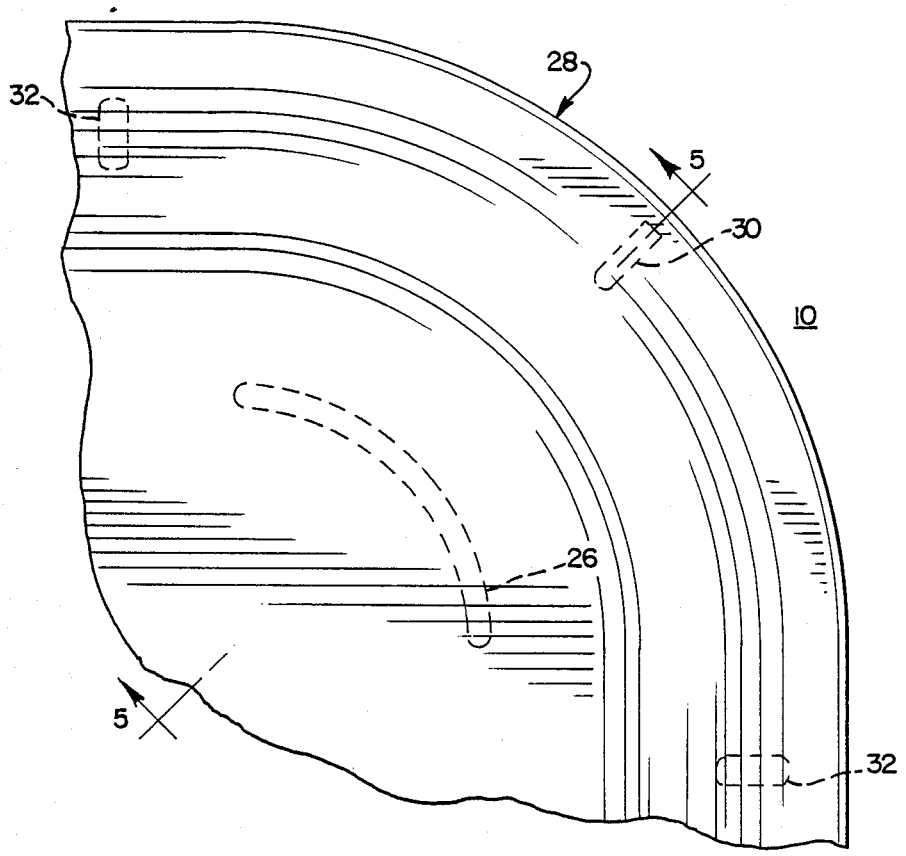
FIG. 4 is a partial top plan view of one corner of the preferred embodiment of the present invention.

In FIG. 4, a corner of the apparatus 10 is illustrated in top plan view with the location of stand-off structures 32, channel-filling structure 30, and arcuate foot 26 of the corner illustrated shown in phantom. FIG. 4 provides an orientation for FIG. 5, which is a partial section view of the preferred embodiment of the apparatus 10 taken along Section 5—5 in FIG. 4.

Figure 5:
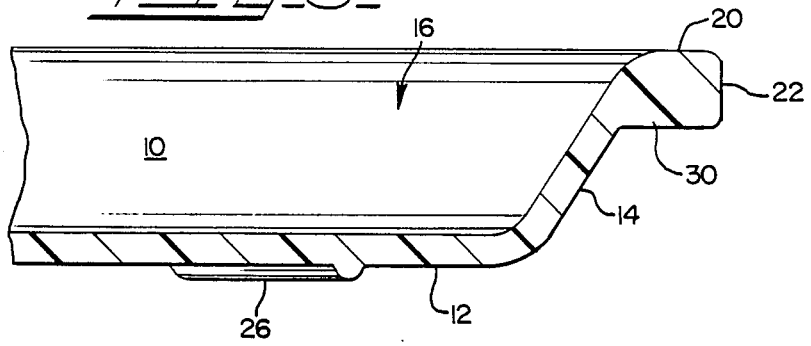
FIG. 5 is a partial section view of the preferred embodiment of the present invention taken along section 5—5 in FIG. 4.

In FIG. 5, the channel-filling structure 30 is illustrated as integrally formed with the side 14, the web 20, and the skirt 22. It should be recalled that channel-filling structure 30 is preferably situated within the limits of each extended skirt section 28. The purpose of the channel-filling structure 30 is to preclude the jamming of an adjacent lower tray in a stacked orientation within the channel 24 of an upper tray. In particular, the channel-filling structure 30 is intended to preclude such jamming by non-mating adjacent trays, such as those which might be in a user's inventory having been purchased from a different manufacturer than the manufacturer of the preferred embodiment of the present invention illustrated herein.

Figure 7:
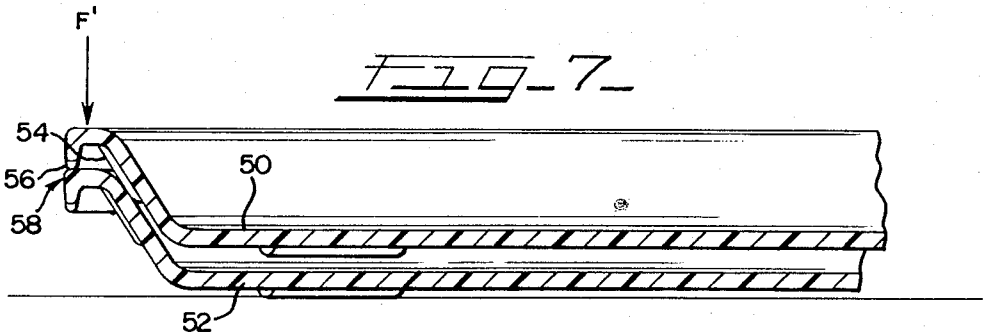
FIG. 7 is a partial section view of the preferred embodiment of the present invention in stacked relation.
Figure 6:
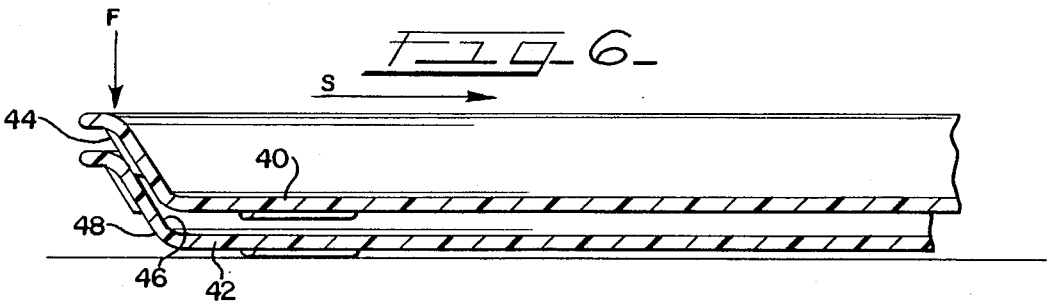
FIG. 6 is a partial section view of prior art devices in stacked relation.

FIGS. 6 and 7 compare the stacking relation of prior art apparata for transporting articles and the preferred embodiment of the present invention. FIG. 6 is a partial section view of prior art apparata in stacked relation in a view similar to the view of FIG. 2. Accordingly, in FIG. 6, an upper apparatus 40 is nested within a lower apparatus 42. In such stacked, nested relation, the point of contact between the upper apparatus 40 and the lower apparatus 42 occurs at stand-off structure 44 associated with upper apparatus 40. Thus, the inner surface 46 of wall 48 of lower apparatus 42 bears against the stand-off structure 44 of upper apparatus 40. In such an orientation the area of contact between the apparata 40, 42 is limited. However, when a force is applied to the upper apparatus 40 at the point and in the direction indicated by arrow F in FIG. 6, the upper apparatus 40 will shift with respect to the lower apparatus 42 in a direction indicated by the arrow S in FIG. 6. It is this tendency to shift in response to downward force which results in slipping between adjacent prior art apparata such as upper apparatus 40 and lower apparatus 42 in FIG. 6 and causes stacks of prior art apparata to exhibit unstable tendencies.

FIG. 7 is a partial section view of the preferred embodiment of the present invention in stacked relation. In FIG. 7, an upper tray 50 is nested within a lower tray 52. The upper tray 50 contacts the lower tray 52 at two structural areas: an area established by the abutment of the stand-off structure 54 of upper tray 50, and the area of abutment of the extended skirt section 56 of upper tray 50 and the bead structure 58 of lower tray 52. The application of a force as indicated by the arrow F′ in FIG. 7 results in a further urging of the extended skirt section 56 of the upper tray 50 against the bead structure 58 of lower tray 52. Thus, with the structure of the preferred embodiment of the present invention, the force F′ yields a much-reduced tendency to shift upper tray 50 with respect to lower tray 52 than is exhibited by the prior art structures illustrated in FIG. 6. As a result, a stacked orientation of apparata constructed in accordance with the preferred embodiment of the present invention, as illustrated in FIG. 7, is more stable than a stacked orientation of prior art devices, as illustrated in FIG. 6.

By limiting the extended skirt section 28 (a structural feature best understood by referring to FIGS. 1 and 2) an air gap is established along at least a partial expanse of the periphery of the apparatus 10 in a stacked relation. The air gap thus established promotes drying of the trays in a stacked relation by allowing air to flow intermediate adjacent trays in a stacked relation. Further, the apparata of the present invention, especially in their employment in such environments as food service operations, are often dropped or otherwise subjected to impact. The corners of such trays are generally especially subject to damage by cracking, chipping, or the like. By providing an extended skirt section such as extended skirt section 28 in FIGS. 1 and 2, a greater mass of material is provided in the bead structure 18 and thereby provides a greater resistance to damage from such impacts as are anticipated to be experienced by such trays in their operating environment.

The integral channel-filling structure 30 (see FIG. 5) further strengthens the corners against damage from such impacts.

It is to be understood that, while the detailed drawings and specific examples given describe preferred embodiments of the invention, they are for the purpose of illustration only, that the apparatus of the invention is not limited to the precise details and conditions disclosed and that various changes may be made therein without departing from the spirit of the invention which is defined by the following claims.

I claim:

1. An apparatus for transporting articles comprising:

a transporting well having a generally planar polygonal bottom and a plurality of walls, each of said plurality of walls depending from a first side of said bottom to an upper extremity; and a substantially rigid bead structure joining each of said plurality of walls substantially at its respective upper extremity;

said bead structure defining a peripheral channel adjacent said plurality of walls outboard of said well, said channel being bounded by said plurality of walls, by a web extending substantially from said respective upper extremities, and by a skirt depending from said web;

said skirt extending a first distance from said web at preselected sections of said channel, and said skirt extending a second distance from said web at other sections of said channel, said first distance being greater than said second distance;

said preselected sections being located at each of said plurality of corners.

2. An apparatus for transporting articles as recited in claim 1 wherein said bottom defines a plurality of corners, and said plurality of walls generally retain said plurality of corners in planes substantially parallel to said bottom.

3. An apparatus for transporting articles as recited in claim 2 wherein all of said respective upper extremities are substantially equally displaced from said bottom.

4. An apparatus for transporting articles as recited in claim 1 wherein said preselected sections delimit an arc substantially centered on each of said plurality of corners.

5. An apparatus for transporting articles as recited in claim 3 wherein said preselected sections delimit an arc substantially centered on each of said plurality of corners.

6. An apparatus for transporting articles as recited in claim 4 wherein each said arc is substantially 90 degrees.

7. An apparatus for transporting articles as recited in claim 5 wherein each said arc is substantially 90 degrees.

8. An apparatus for transporting articles as recited in claim 4 wherein the apparatus further comprises channel-filling means for substantially filling an expanse of said channel, said channel-filling means being substantially at center of each said arc.

9. An apparatus as recited in claim 5 wherein the apparatus further comprises channel-filling means for substantially filling an expanse of said channel, said channel filling means being substantially at center of each said arc.

10. An apparatus as recited in claim 6 wherein the apparatus further comprises channel-filling means for substantially filling an expanse of said channel, said channel filling means being substantially at center of each said arc.

11. An apparatus as recited in claim 7 wherein the apparatus further comprises channel-filling means for substantially filling an expanse of said channel, said channel-filling means being established substantially at center of each said arc.

12. An apparatus as recited in claim 6 wherein the apparatus further comprises a plurality of stand-off means for limiting expanse of contact area with an abutting substantially planar surface; said plurality of stand-off means being disposed about said plurality of walls outboard of said well substantially at each limit of each said arc.

13. An apparatus as recited in claim 7 wherein the apparatus further comprises a plurality of stand-off means for limiting expanse of contact area with an abutting substantially planar surface; said plurality of stand-off means being disposed about said plurality of walls outboard of said well substantially at each limit of each said arc.

14. An apparatus for transporting articles comprising:

a transporting well having a generally planar polygonal bottom and a plurality of walls, each of said plurality of walls depending from a first side of said bottom to an upper extremity; and a substantially rigid bead structure joining each of said plurality of walls substantially at its respective upper extremity;

said bead structure defining a peripheral channel adjacent said plurality of walls outboard of said well, said channel being bounded by said plurality of walls, by a web extending substantially from said respective upper extremities, and by a skirt depending from said web;

said skirt extending a first distance from said web at preselected sections of said channel, and said skirt extending a second distance from said web at other sections of said channel, said first distance being greater than said second distance;

said bottom defining a plurality of corners, and said plurality of walls generally retaining said plurality of corners in planes substantially parallel to said bottom;

all of said respective upper extremities being substantially equally displaced from said bottom;

said preselected sections of said channel being located at at least two associated corners of said plurality of corners;

said preselected sections delimiting an arc substantially centered on said at least two associated corners;

each said arc being substantially 90 degrees; and the apparatus further comprising channel-filling means for substantially filling an expanse of said channel, said channel-filling means being substantially at center of said arc at said at least two associated corners.

15. An apparatus for transporting articles comprising:

a transporting well having a generally planar polygonal bottom and a plurality of walls, each of said plurality of walls depending from a first side of said bottom to an upper extremity; and a substantially rigid bead structure joining each of said plurality of walls substantially at its respective upper extremity;

said bead structure defining a peripheral channel adjacent said plurality of walls outboard of said well, said channel being bounded by said plurality of walls, by a web extending substantially from said respective upper extremities, and by a skirt depending from said web;

said skirt extending a first distance from said web at preselected sections of said channel, and said skirt extending a second distance from said web at other sections of said channel, said first distance being greater than said second distance;

said bottom defining a plurality of corners, and said plurality of walls generally retaining said plurality of corners in planes substantially parallel to said bottom;

all of said respective upper extremities being substantially equally displaced from said bottom;

said preselected sections of said channel being located at each of said plurality of corners;

said preselected sections delimiting an arc substantially centered on each of said plurality of corners;

each said arc being substantially 90 degrees; and the apparatus further comprising channel-filling means for substantially filling an expanse of said channel, said channel filling means being substantially at center of said arc at each of said plurality of corners.

* * * * *